US010240762B1

(12) United States Patent
Kay

(10) Patent No.: US 10,240,762 B1
(45) Date of Patent: Mar. 26, 2019

(54) ELECTRIC RECESSIBLE TRACK ASSEMBLY AND METHOD OF INSTALLATION IN STANDARD ⅝-INCH THICK DRYWALL

(71) Applicant: PureEdge Lighting LLC, Chicago, IL (US)

(72) Inventor: Gregory L. Kay, Chicago, IL (US)

(73) Assignee: PureEdge Lighting LLC, Chicago, IL (US)

( * ) Notice: Subject to any disclaimer, the term of this patent is extended or adjusted under 35 U.S.C. 154(b) by 0 days.

(21) Appl. No.: 15/838,616

(22) Filed: Dec. 12, 2017

(51) Int. Cl.
*F21V 21/04* (2006.01)
*F21V 21/005* (2006.01)

(52) U.S. Cl.
CPC ..... *F21V 21/048* (2013.01); *F21V 21/005* (2013.01)

(58) Field of Classification Search
CPC .... F21S 8/02; F21S 8/022; F21S 8/024; F21S 8/026; F21S 8/028; F21V 5/015; F21V 5/04; F21V 21/048; F21V 21/005
See application file for complete search history.

(56) References Cited

U.S. PATENT DOCUMENTS

| | | | | |
|---|---|---|---|---|
| 6,435,697 | B1 * | 8/2002 | Simmons | F21V 17/107 362/219 |
| 9,551,469 | B2 * | 1/2017 | Grigore | F21S 8/02 |
| 2013/0279160 | A1 * | 10/2013 | Myers | F21K 9/50 362/224 |
| 2016/0033117 | A1 * | 2/2016 | Grigore | F21V 33/006 362/222 |
| 2017/0074471 | A1 * | 3/2017 | Panek | F21S 2/005 |
| 2017/0082266 | A1 * | 3/2017 | Ruhland | F21V 7/0016 |

* cited by examiner

*Primary Examiner* — Joseph L Williams
*Assistant Examiner* — Jose M Diaz
(74) *Attorney, Agent, or Firm* — Bishop, Diehl & Lee, Ltd.

(57) ABSTRACT

A recessible track for a lighting system, the track including a channel defined by first and second opposing sidewalls, a base wall, and a longitudinal opening opposite the base wall, a first lateral flange extending laterally from an exterior of the first sidewall substantially parallel to the base wall and for at least a portion of the length of the track, and a second lateral flange extending from an exterior of the second sidewall substantially parallel to the base wall and for at least a portion of the length of the track. The channel is dimensioned such that it does not extend past a thickness of standard ⅝-inch drywall when recessed while the first and second lateral flanges secure the channel to the surface. The flanges may be concealed by blending with the drywall using a concealing material such as a joint compound or the like.

19 Claims, 8 Drawing Sheets

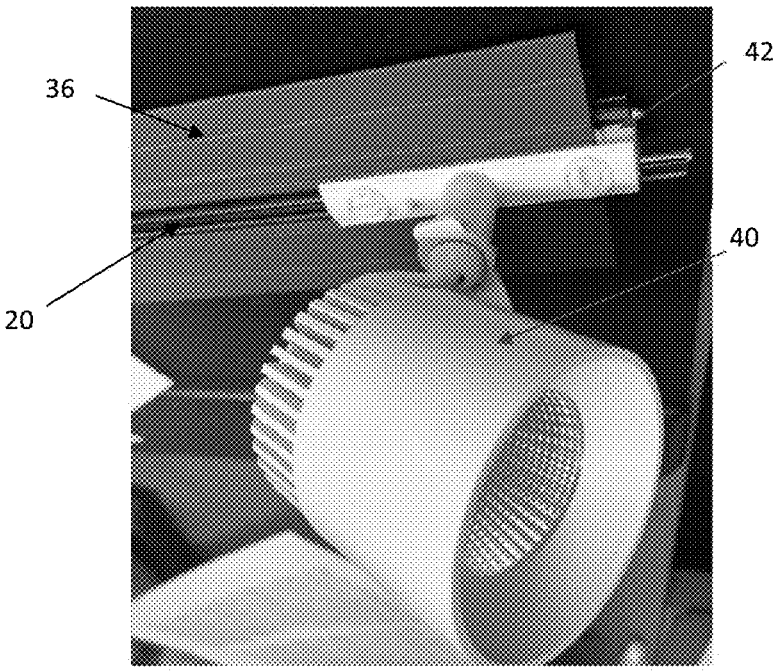
FIG. 9
FIG. 10
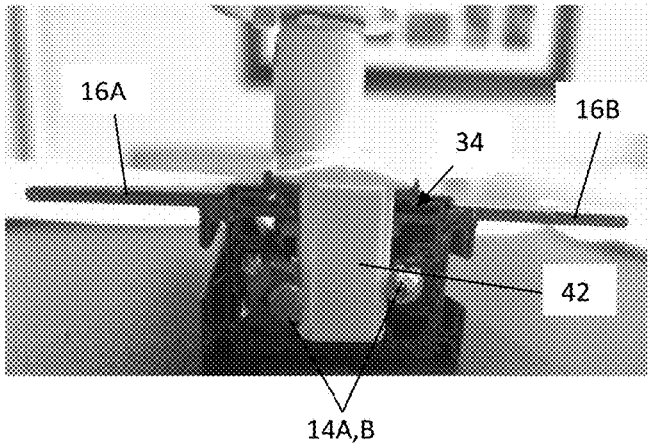

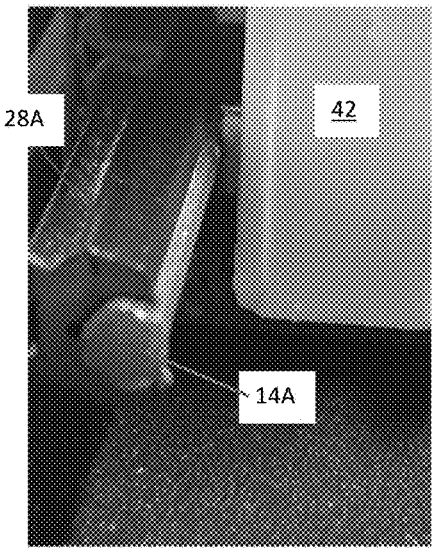
FIG. 11
FIG. 12
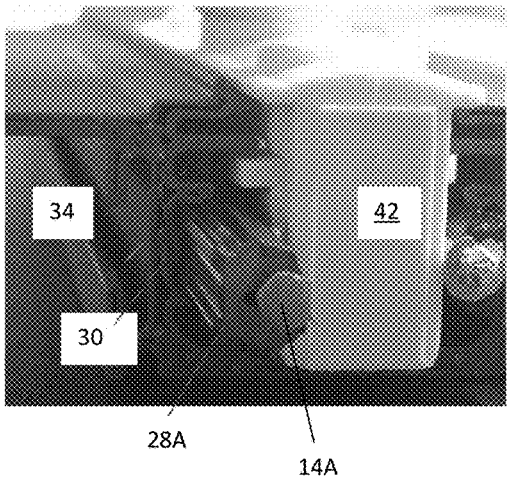

ELECTRIC RECESSIBLE TRACK ASSEMBLY AND METHOD OF INSTALLATION IN STANDARD ⅝-INCH THICK DRYWALL

TECHNICAL FIELD OF THE INVENTION

The present invention relates to track lighting and recessed lighting. Specifically, the invention relates to a method and system for recessing track lighting into a drywall surface, such as a ceiling or wall. Most specifically, installation of the disclosed system is in standard ⅝-inch thick drywall.

BACKGROUND OF THE INVENTION

Lighting is an important feature when designing work or living space. However, it is not enough that the lighting provides sufficient illumination to an area. The lighting fixtures have an aesthetic function as well. Two common permanent lighting fixtures are known as track lighting and recessed lighting.

Track lighting is a method of lighting where light fixtures are attached anywhere on a continuous track device which contains electrical conductors. This is in contrast to directly routing electrical wiring to individual light positions. Tracks are either mounted to ceilings or walls, lengthwise down beams, or crosswise across rafters or joists. They can also be hung with rods from especially high places like vaulted ceilings.

Typical systems have line voltage running through a track. The track may have more than one live conductor, so that multiple switched circuits can be used to control different lights on the same track. This feature allows light fixtures to be maneuvered to any position along the continuous track, as needed or desired. However, the visible track has drawbacks when the aesthetics are important. Also, if a surface with track lighting is being painted, the track needs to be removed entirely.

Recessed lights (aka, downlights, can (or canister) lights) are different than track lighting in that they are installed into a hollow opening—usually round—in a ceiling. When installed, it appears that light is shining from a hole in the ceiling, concentrating the light in a downward direction as a broad floodlight or narrow spotlight. Typically, little if any of the actual light fixture is observable.

However, recessed lights are fixed light sources which cannot be readily moved without some skilled electrical re-wiring and surface patching. Another drawback is recessing the lights requires that either the lights be positioned either joists or the joist must be notched or altered in some way to accommodate the light. The cuffing of ceiling joists is an undesirable option in many cases.

The present invention provides a lighting system without the aesthetic drawbacks of track lighting and without the lighting and installation limitations of standard recessed lights. By combining only the useful features of both systems into a single device, lighting aesthetics, changeability, and adjustability are improved. The present lighting system can be installed without exposure of unsightly brackets and tracks and without the need to notch or otherwise altering existing studs or joists.

Until the invention of the present application, these and other problems in the prior art went either unnoticed or unsolved by those skilled in the art. The present invention provides a lighting track system which is capable of multiple configurations with the associated light fixtures without sacrificing design, style or affordability.

SUMMARY OF THE INVENTION

There is disclosed herein an improved track lighting system and assembly which avoid the disadvantages of prior devices while affording additional structural and operating advantages. A recessible electric track, track assembly and recessed electric track construction method are described in such detail that a person of reasonable skill in the art could make and use these inventions.

Generally speaking, the recessible electric track comprises a section of extruded track defined by a channel having first and second opposing sidewalls, a base wall, and a longitudinal opening opposite the base wall. The channel has a depth which is no more than the thickness of standard ⅝ inch drywall.

Within the channel there is a first bus rod extending the length of the track section and secured to the first sidewall, and a second bus rod extending the length of the track and secured to the second sidewall. Adjacent to the opening of the channel is a first lateral flange extending from an exterior of the first sidewall substantially parallel to the base wall, and a second lateral flange extending from an exterior of the second sidewall substantially parallel to the base wall. The flanges allow the track to be attached to a surface while having the channel recessed in the surface. The first and second bus rods are coupled to one of either an AC or DC power source so as to conduct electricity within the channel.

In a specific embodiment, the track is preferably dimensioned to fit within the depth of standard drywall boards (i.e., ⅝ inch). Further, the electric track system comprises a first bus rod carrier and a second bus rod carrier which are used to secure the first and second bus rods within the channel. The carriers preferably slidably mount within corresponding grooves on the interior of the channel sidewalls.

In another specific embodiment, the electric track system further comprises first and second fixture retention channels formed on an interior surface of the first and second sidewalls, respectively. At least one light fixture can be slidably engaged within the first and second fixture retention channels to be powered by the bus rods. Additionally, the first and second lateral flanges are configured to attach to a surface and textured to allow concealment by taping and a joint compound.

In a preferred embodiment, the electric track system further comprises a channel cover slidably mounted to the section of track to cover at least a length of the longitudinal opening.

A track lighting system is also described and comprises a section of extruded track comprising a channel having first and second opposing sidewalls, a base wall, and a longitudinal opening opposite the base wall, a first lateral flange extending laterally from an exterior of the first sidewall substantially parallel to the base wall and for at least a portion of the length of the track, and a second lateral flange extending from an exterior of the second sidewall substantially parallel to the base wall and for at least a portion of the length of the track. The lighting system also comprises a first bus rod secured within the channel to the first sidewall, a second bus rod secured within the channel to the second sidewall, at least one light fixture having a base slidably retained within the channel and covering a portion of the longitudinal opening, the base having contacts electrically engaged with the first and second bus rods, and a channel cover slidably mounted to the section of extruded track to cover a portion of the longitudinal opening not covered by the at least one light fixture. The first and second bus rods are coupled to one of either an AC or DC power source and the first and second lateral flanges are secured to a surface such that the channel is recessed within the surface.

Finally, a method for recessing track lighting is also described herein. Generally, the method comprises the steps of providing a predefined length of an embodiment of the electric track described above, creating an opening defined within a surface, placing the channel of the electric track within the opening, securing the first and second lateral flanges to the surface to retain the channel within the opening, mounting a light fixture within the electric track so that contacts on the fixture engage the first and second bus rods, and then supplying electricity to the first and second bus rods to activate a light within the light fixture.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings, embodiments thereof, from an inspection of which, when considered in connection with the following description, the subject matter sought to be protected, its construction and operation, and many of its advantages should be readily understood and appreciated.

FIG. 9 is a perspective view of an embodiment of a lighting fixture secured within the channel of an embodiment of the track assembly;

FIG. 10 is close up cross section showing the base portion of the lighting fixture illustrated in FIG. 9;

FIG. 11 is close up showing a connection between a bus rod and a contact on the base of the lighting fixture of FIG. 9;

FIG. 12 is another close-up cross section of the track assembly with lighting fixture of FIG. 9;

DETAILED DESCRIPTION OF PREFERRED EMBODIMENTS OF THE INVENTION

Figure 1:
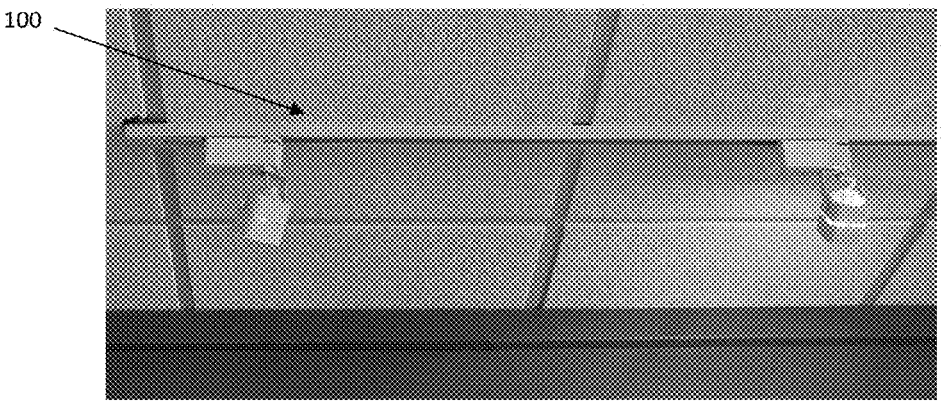
FIG. 1 (Prior Art)
FIG. 1 is a perspective view of typical prior art track lighting attached to a ceiling.

While this invention is susceptible of embodiments in many different forms, there is shown in the drawings and will herein be described in detail at least one preferred embodiment of the invention with the understanding that the present disclosure is to be considered as an exemplification of the principles of the invention and is not intended to limit the broad aspect of the invention to any of the specific embodiments illustrated.

Figure 2:
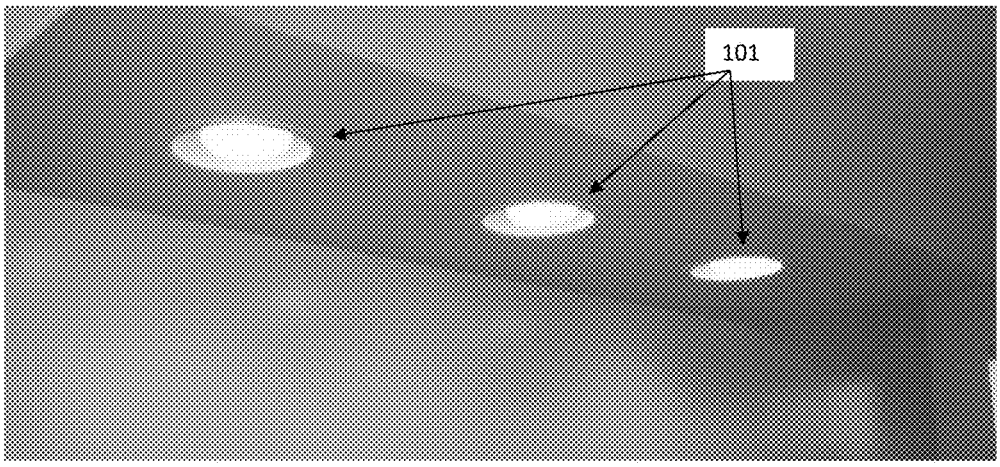
FIG. 2 (Prior Art)
FIG. 2 is a perspective view of three typical prior art recessed (or can) lights in a ceiling.

With reference to the lighting systems of FIGS. 1 and 2, a standard track lighting system and recessed lighting can be seen. The benefits of the present assembly and method over these prior art systems are significant. The track lighting system 100 of FIG. 1 allows the two light fixtures to be moved along the track to desired positions. However, the system 100 lacks favorable aesthetics, due to its exposed industrial-like track, and provides an obstacle to painting. Further, adding a third light fixture, or replacing one of the two existing fixtures, involves potential complicated wiring issues. The recessed lights 101 of FIG. 2, while considered to be more aesthetically-pleasing, with most of the structure being concealed, have considerable drawbacks with respect to actual lighting functionality. The recessed lights 101 illuminate straight down with no ability to move to change lighting emphasis. Similar to the track lighting, the addition or removal of a recessed light fixture can be quite involved.

Referring now to FIGS. 3-12, there is illustrated a recessible track lighting system, generally designated by the numeral 10. Generally speaking, the system 10 is comprised of a section of extruded track 12 having first and second bus rods 14A, 14B mounted inside the track with lateral flanges 16A, 16B on the exterior for mounting purposes. As will be described in further detail below, the track 12 is configured to be mounted within an opening on a surface 50 and connected to a proper AC or DC power source (not shown). Light fixtures 40 can then be readily added to, moved, and removed from the system 10 without complicated wiring issues.

Figure 3:
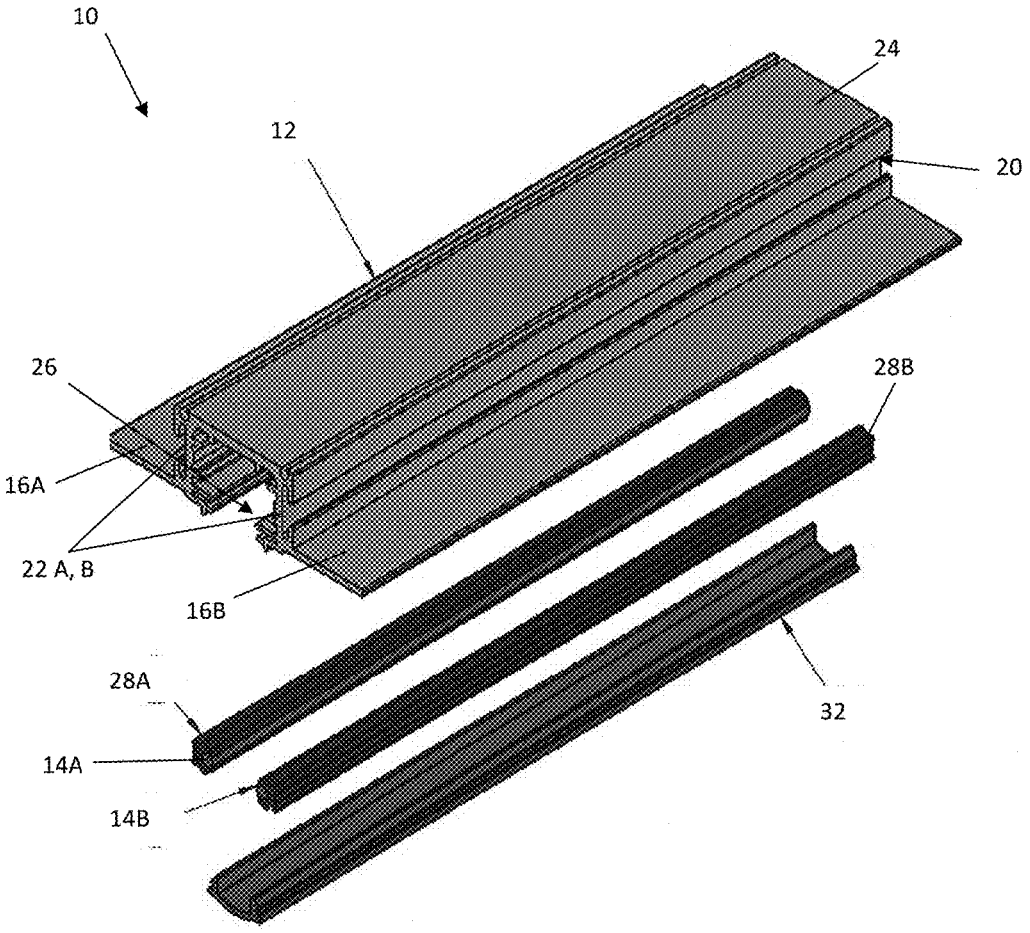
FIG. 3 is an exploded view of an embodiment of a track assembly for creating recessed track lighting in accordance with the present disclosure.
Figure 4:
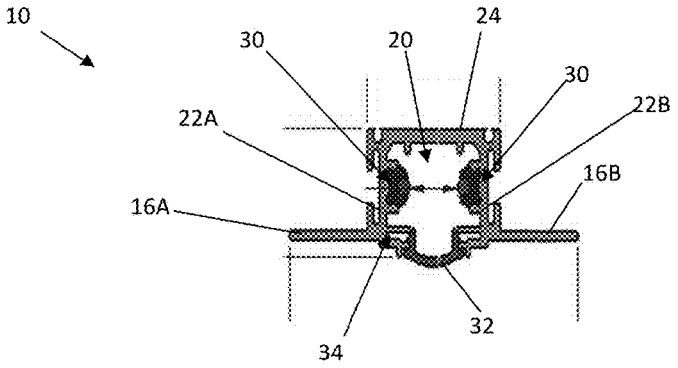
FIG. 4 is an end view of an embodiment of the constructed electric track assembly shown in FIG. 3.
Figure 5:
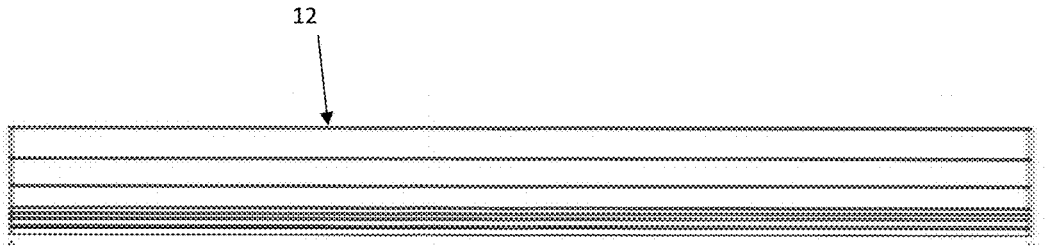
FIG. 5 is a side view of the constructed track assembly of FIG. 4.

An exploded view of an embodiment is shown in FIG. 3, with an end view in FIG. 4 and a side view in FIG. 5. The extruded track 12 is preferably cut into lengths and includes a channel 20 defined by two opposing sidewalls 22A, B and a base wall 24, with an opening 26 opposite the base wall 24. The lengths of track 12 can be connected end-to-end to achieve extended lengths. In specific embodiments, the material of the track 12 can be curved (not shown) to allow more creative recessed lighting systems 10. In all embodiments, the channel 20 has a depth of no more than the standard construction drywall thickness of ⅝ inches. This allows the track 12 to pass over studs and joists 60 (e.g., see FIGS. 6, 7, 8A and 8B).

A first bus rod 14A extends the length of the track section 12 and is secured within the channel 20 to a sidewall 22A. A second bus rod 14B also extends the length of the track 12 and is secured within the channel 20 to the opposite sidewall 22B. The lateral flanges 16A, B extend from an exterior of the sidewalls 22, preferably along a top edge, as shown best in FIG. 4. The flanges 16 may run the entire length of the track 12 or only portions of the track 12 if desired.

As noted above, the track 12 is dimensioned to be retrofit within an existing wall or ceiling. That is, regardless of the positioning and length of track 12, the track 12 will not require alteration of wall studs or ceiling joists 60 to accommodate system 10. The depth of the channel 20 is such that it is substantially flush with standard ⅝ inch drywall when recessed (see FIG. 8), as explained in greater detail below.

The bus rods 14 are preferably secured within carriers 28 A, B. The carriers 28 are comprised of an insulating material and are configured to slide into grooves 30 positioned on an interior surface of the sidewalls 22. The distance between the two bus rods 14 should provide a gap into which a lighting fixture base 42 (FIGS. 10-12) may slide through while maintaining contact with the bus rods 14. A channel cover 32 is preferably used to cover the channel opening 26. The cover 32 is preferably configured to slide onto the opening 26 from either end of the track 12 or may be made to snap-fit over the opening 26. However, where lighting fixtures 40 are positioned in and extend from the channel 20, the channel cover 32 may cover only the uncovered portions of the opening 26.

With reference to FIGS. 9-12, a fixture retention channel 34 is formed in the track channel 20 between the sidewalls 22 A, B just below the opening 26, as shown in FIG. 4. The retention channel 34 runs the length of the track 12 and allows a light fixture 40 to be retained on the track 12. More importantly, the bus carriers 28 A, B are secured to the sidewalls 22 just below the fixture retention channel 34 with the bus rods 14 A, B facing inward and partially exposed. As previously noted, the gap created between the bus rods 14 allows a base 42 of the light fixture 40 to maintain contact with the bus rods 14 to power the light fixture 40. Preferably the bus rods 14 are hard-wired to an AC or DC power source.

Figure 6:
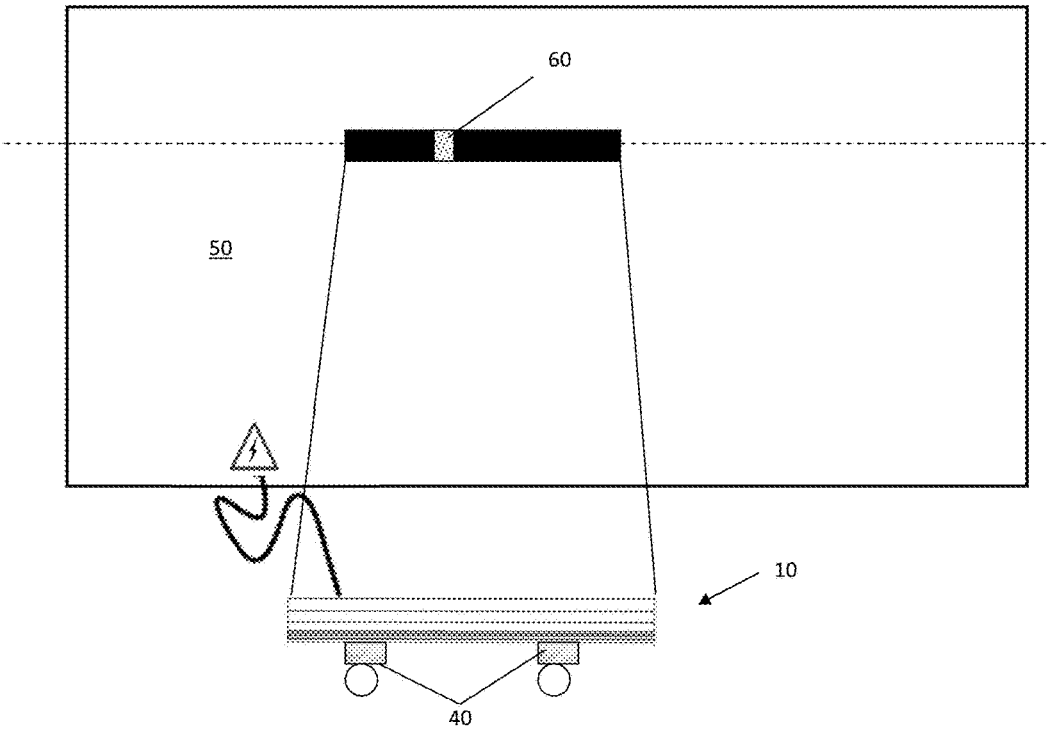
FIG. 6 is an illustration of an embodiment of a length of the track assembly, including two lighting fixtures, being placed within an opening of a surface, such as a ceiling.
Figure 7:
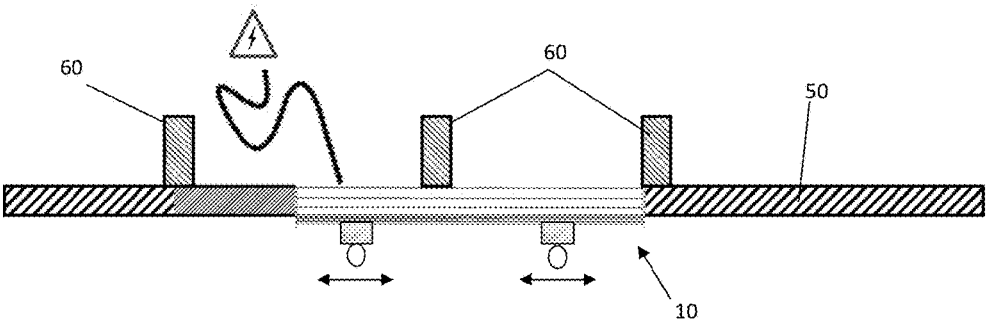
FIG. 7 is a side cross section of the embodiment of the track assembly of FIG. 6 showing the assembly secured within the surface.
Figure 8A:
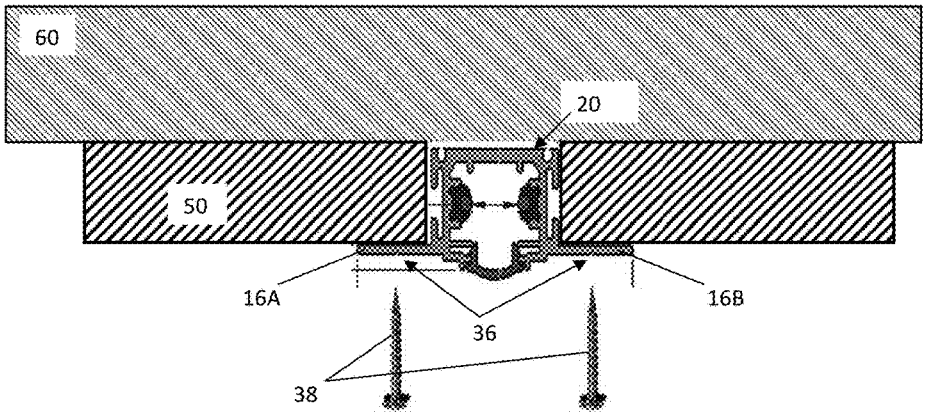
FIG. 8A is an end cross section of an embodiment of the track assembly illustrating fastening the lateral flanges through the surface to a stud or joist with the channel recessed.
Figure 8B:
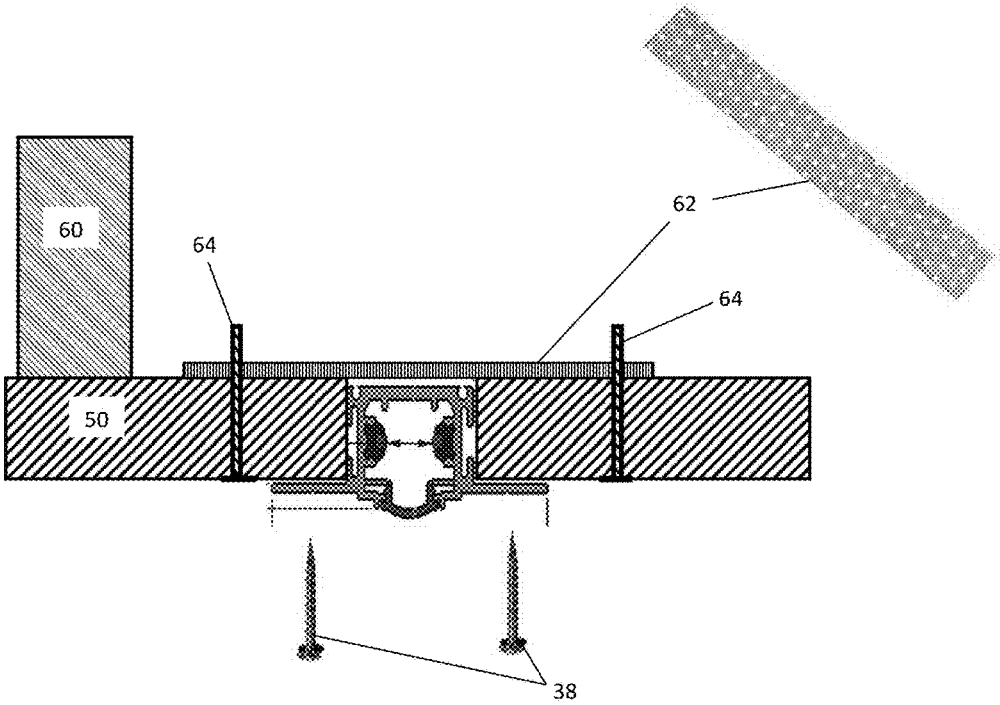
FIG. 8B is an end cross section of an embodiment of the track assembly illustrating fastening the lateral flanges through the surface to a perforated metal strap with the channel recessed.

Installation of the recessed track lighting assembly 10 is illustrated in FIGS. 6-8. Once the assembly 10 is properly prepared (preferably without the light fixtures 40 connected), it may be inserted into an opening in a surface 50, such as a ceiling. Connection of the power cord to the power source may be required before insertion of the assembly 10. The opening should be cut into an existing surface 50 so as to allow only the channel 20 of the assembly 10 to fit into the opening with the flanges 16 A, B abutting an exterior of the surface, as shown in FIGS. 7, 8A and 8B. A fastener groove 36 may be constructed into each flange 16, preferably along a midline. Fasteners 38, such as screws or finishing nails, may be used to secure the assembly in place.

FIGS. 6, 7 and 8A illustrate the track 12 being installed to cross over an existing wall stud or ceiling joist 60. While the embodiment illustrates a perpendicular orientation to the stud 60, it may be placed into a surface 50 to cross at any angle to the stud 60. For a most secure installation, it is preferred that fasteners 38 pass through flange 16, surface 50 and into a stud 60.

Where the track 12 runs parallel to a stud 60, as shown in FIG. 8B, a perforated metal mounting strap 62 may be secured across a backside of the opening 26 using fasteners 64, preferably every 32 inches. The straps 62 have a plurality of holes therein so that the fasteners 38 are sure to encounter a hole as they pass through the drywall surface 50. The straps 62 provide additional support to the system 10 where studs and joist 60 are not present.

Once secured, the textured surfaces of the flanges 16 A, B will allow concealment of at least portions of the recessed track 12 using joint tape and joint compound. In preferred embodiments, light fixtures 40 are intended to extend above the channel 20 so only the flanges 16 A,B need be concealed. That is, the channel opening 26 should remain accessible after final installation. Accordingly, once the surface 50 is painted and dry—including the covered flanges—at least one lighting fixture 40 can be added to the assembly 10. Additional fixtures can be added to the recessed track assembly 10 as needed and removed when no longer desired. A channel cover 32 may be added between fixtures 40, if desired.

By "joint compound" and "wall compound" it is meant that any material used on a surface to cover, conceal or even decorate any portion of the surface. Typically, the material includes a perforated tape and a compound widely referred to in the industry as "mud." However, the term concealing material may also include textured paints, wall paper, millwork or other such materials appropriate for the desired aesthetic effect.

Figure 13:
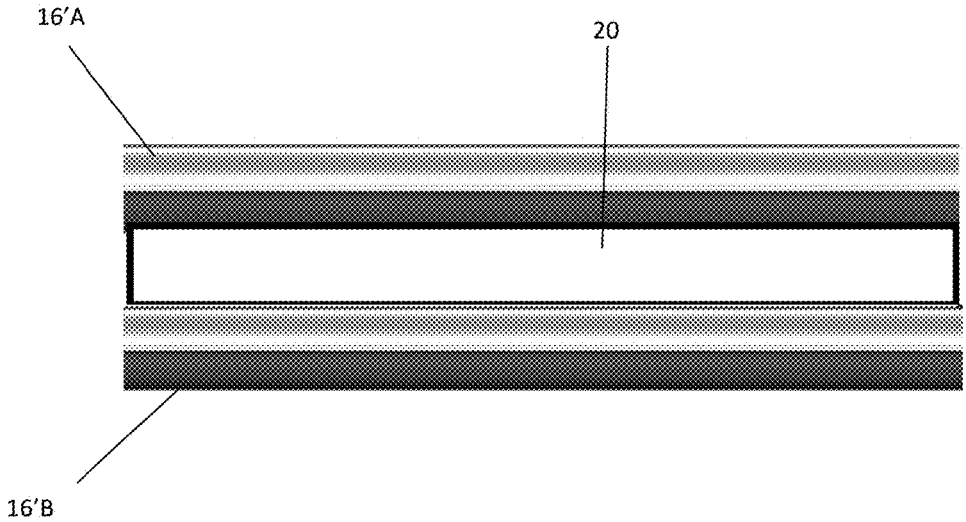
FIG. 13 is a top view of an alternate embodiment of the track assembly showing decorative flanges.
Figure 14:
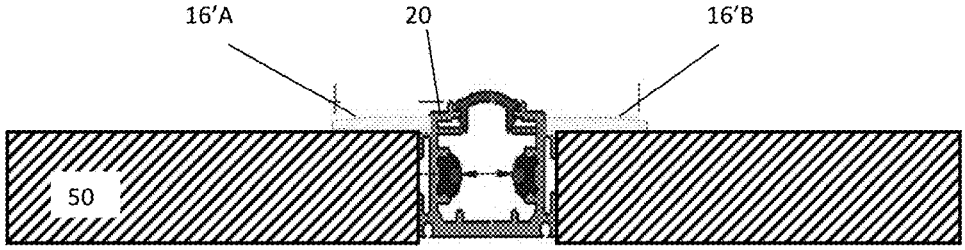
FIG. 14 is a cross section of an alternate embodiment of the track assembly having decorative flanges.

In an alternate embodiment shown in FIGS. 13 and 14, the lateral flanges 16'A and 16'B include a decorative finish. The flanges 16'A/B are preferably decoratively-shaped and may be electroplated or powder-coated to achieve a desired finish and color. As such, the flanges 16'A/B would not be covered by a concealing material.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An electric track system comprising:

a section of extruded track having a length and defined by a channel having first and second opposing sidewalls, a base wall, and a longitudinal opening opposite the base wall;

a first bus rod extending the length of the track section and secured within the channel to the first sidewall;

a second bus rod extending the length of the track and secured within the channel to the second sidewall;

a first lateral flange extending laterally from an exterior of the first sidewall substantially parallel to the base wall and for at least a portion of the length of the track; and a second lateral flange extending from an exterior of the second sidewall substantially parallel to the base wall and for at least a portion of the length of the track;

wherein the height of the channel sidewalls is approximately equal to a ⅝-inch surface thickness and the first and second bus rods are coupled to a power source.

2. The electric track system of claim 1, further comprising a first bus rod carrier and a second bus rod carrier, wherein the first bus rod is secured within the first bus rod carrier and the second bus rod is secured with the second bus rod carrier.

3. The electric track system of claim 2, wherein the first sidewall of the channel comprises a first groove and the second sidewall of the channel comprises a second groove, and the first and second bus rod carriers are slidably mounted within the first and second grooves, respectively.

4. The electric track system of claim 1, wherein the first and second lateral flanges are configured to attach to a surface.

5. The electric track system of claim 4, wherein the first and second lateral flanges are textured to promote adhesion by a joint compound.

6. The electric track system of claim 1, further comprising a fixture retention channel formed on an interior surface of the first and second sidewalls.

7. The electric track system of claim 6, further comprising at least one light fixture slidably engaged with the fixture retention channel and covering a portion of the longitudinal opening.

8. The electric track system of claim 1, further comprising a channel cover slidably mounted to the section of track to cover at least a length of the longitudinal opening.

9. The electric track system of claim 7, further comprising a channel cover slidably mounted to the section of track to cover the longitudinal opening not covered by the at least one light fixture.

10. The electric track system of claim 1, wherein the first and second lateral flanges extend laterally a distance substantially equal to a width of the base wall.

11. A track lighting system comprising:

a section of extruded track having a predefined length and comprising:

a channel having first and second opposing sidewalls, a base wall, and a longitudinal opening opposite the base wall;

a first lateral flange extending laterally from an exterior of the first sidewall substantially parallel to the base wall and for at least a portion of the length of the track; and a second lateral flange extending from an exterior of the second sidewall substantially parallel to the base wall and for at least a portion of the length of the track;

a first bus rod secured within the channel to the first sidewall;

a second bus rod secured within the channel to the second sidewall; and at least one light fixture having a base slidably retained within the channel, the base having contacts electrically engaged with the first and second bus rods;

wherein the height of the channel sidewalls is approximately equal to a ⅝-inch surface thickness, the first and second bus rods are coupled to a power source and the first and second lateral flanges are secured to a surface such that the channel is recessed within the surface.

12. The track lighting system of claim 11, further comprising a channel cover slidably mounted to the section of extruded track to cover at least a portion of the longitudinal opening.

13. The track lighting system of claim 12, wherein the channel cover and the first and second lateral flanges are configured to allow coverage by a concealing material.

14. The electric track system of claim 11, further comprising a first bus rod carrier and a second bus rod carrier, wherein the first bus rod is secured within the first bus rod carrier and the second bus rod is secured with the second bus rod carrier.

15. The electric track system of claim 14, wherein the first sidewall of the channel comprises a first groove and the second sidewall of the channel comprises a second groove, and the first and second bus rod carriers are slidably mounted within the first and second grooves, respectively.

16. A method for recessing a track for lighting, the method comprising the steps of:

providing a length of track comprising:

a channel having first and second opposing sidewalls, a base wall, and a longitudinal opening opposite the base wall;

a first bus rod extending the length of the track section and secured within the channel to the first sidewall;

a second bus rod extending the length of the track and secured within the channel to the second sidewall;

a first lateral flange extending laterally from an exterior of the first sidewall substantially parallel to the base wall and for at least a portion of the length of the track; and a second lateral flange extending from an exterior of the second sidewall substantially parallel to the base wall and for at least a portion of the length of the track;

creating an opening defined within a surface having a thickness of ⅝-inch;

coupling the first and second bus rods to a power source;

placing the channel of the track within the opening; and securing the first and second lateral flanges to the surface to retain the channel within the opening such that the channel does not extend beyond the thickness of the surface.

17. The method of claim 16, further comprising the step of mounting a light fixture within the track.

18. The method of claim 16, further comprising the step of concealing at least a portion of the electric track within the opening.

19. The method of claim 18, wherein the step of concealing at least a portion of the electric track comprises the step of applying a concealing material over the lateral flanges.

* * * * *